US007488267B2

(12) United States Patent
Hunt

(10) Patent No.: US 7,488,267 B2
(45) Date of Patent: Feb. 10, 2009

(54) BOWHUNTING DEVICE AND METHOD FOR TRACKING WOUNDED PREY

(75) Inventor: C. Timothy Hunt, Dadeville, AL (US)

(73) Assignee: T & P Game Recovery, LLC, Dadeville, AL (US)

( * ) Notice: Subject to any disclaimer, the term of this patent is extended or adjusted under 35 U.S.C. 154(b) by 421 days.

(21) Appl. No.: 11/219,500

(22) Filed: Sep. 2, 2005

(65) Prior Publication Data

US 2006/0189420 A1 Aug. 24, 2006

Related U.S. Application Data

(60) Provisional application No. 60/710,580, filed on Aug. 23, 2005, provisional application No. 60/648,620, filed on Jan. 31, 2005, provisional application No. 60/606,615, filed on Sep. 2, 2004.

(51) Int. Cl.
*F42B 6/04* (2006.01)

(52) U.S. Cl. ..... 473/581; 473/578

(58) Field of Classification Search ..... 473/578, 473/581

See application file for complete search history.

(56) References Cited

U.S. PATENT DOCUMENTS

| | | | | |
|---|---|---|---|---|
| 3,893,866 | A | 7/1975 | Hollingsworth | |
| 4,463,953 | A * | 8/1984 | Jordan | 473/581 |
| 5,035,435 | A * | 7/1991 | Burgeson et al. | 473/577 |
| 5,836,842 | A * | 11/1998 | McLearan | 473/581 |
| 6,059,677 | A * | 5/2000 | Breshears | 473/581 |
| 6,450,905 | B1 * | 9/2002 | Edlund | 473/581 |
| 2006/0044792 | A1 | 3/2006 | Dallas et al. | |

OTHER PUBLICATIONS

Wikipedia, the free encyclopedia; Staining (biology); Aug. 10, 2005; 7 pgs; wikipedia.org/wiki/Staining.
Zen Cart; Luminol; Online Literature; crimescene.com; Dec. 12, 2005; 2 pgs.
Leber Enterprises, LLC; Bow Hunter's Anectine Pods; Online Literature; turkeytail.com; Aug. 26, 2004; 4 pgs; Madison, MS.
Bayer; Alka-Seltzer; Online Literature; alka-seltzer.com; Aug. 31, 2004; 1 pg.
Risk Reactor; PF-33 Fluorescent Pigment; Online Literature; riskreactor.com; Aug. 22, 2005; 3 pgs; Huntington Beach, CA.
Risk Reactor; Fluorescent Dyes; Online Lliterature; riskreactor.com; Aug. 22, 2005; 1 pg.
Risk Reactor; Fluorescent Pigments; Online Literature; riskreactor.com; Aug. 22, 2005; 1 pg.
Risk Reactor; Black Lights and UV LEDs; Online Literature; riskreactor.com; Aug. 22, 2005; 2 pgs; Huntington Beach, CA.
Risk Reactor; Glow in the Dark Paint; Online Literature; riskreactor.com; Aug. 22, 2005; 2 pgs; Huntington, CA.
Risk Reactor; Glow in the Dark Pigments; Online Literature; riskreactor.com; Aug. 22, 2005; 2 pgs; Huntington, CA.

* cited by examiner

*Primary Examiner*—John Ricci
(74) *Attorney, Agent, or Firm*—Gardner Groff Greenwald & Villanueva P.C.

(57) ABSTRACT

A bowhunting tracking-assist device on an arrow's shaft includes a tracer agent and an agent dispenser. The dispenser releases the agent when the arrow strikes a game animal, and the released agent identifies an enhanced-visibility trail of the fleeing animal. In an example embodiment, the dispenser has wells for holding the agent and a cover that displaces to release the agent when the arrow drives into the animal. The tracer agent preferably comprises one or more compounds that produce visible light to the naked eye and/or under a black light source. Example tracer agents include biological stains that produce visible light upon contact with blood, luminol or another chemiluminescent compound that releases light by a chemical reaction such as may occur when contacting blood, a basic salt such as sodium carbonate or another effervescence-inducing agent, a phosphorescent compound, or a fluorescent compound.

26 Claims, 2 Drawing Sheets

BOWHUNTING DEVICE AND METHOD FOR TRACKING WOUNDED PREY

CROSS-REFERENCE TO RELATED APPLICATION

This application claims the priority benefit of U.S. Provisional Patent Application Ser. No. 60/710,580 filed Aug. 23, 2005, U.S. Provisional Patent Application Ser. No. 60/648,620 filed Jan. 31, 2005, and U.S. Provisional Patent Application Ser. No. 60/606,615 filed Sep. 2, 2004, which are hereby incorporated herein by reference.

TECHNICAL FIELD

The present invention relates generally to hunting wild game and, in particular, to hunting-related devices and methods for tracking wounded game animals.

BACKGROUND OF THE INVENTION

When hunting wild game, hunters aim for a quick and clean kill that puts the animal down right away with little suffering. But even the best hunters do not always achieve this. Sometimes the animal is mortally wounded but still able to flee for a considerable time and distance. This is true for all types of hunting, but particularly for bowhunting because it is difficult to achieve a quick and clean kill with a single arrow.

When a game animal has been wounded but flees, it can be very difficult to track. Even during the day, the animal's blood can be very difficult to see, for example, on leaves, the bare ground, etc. The problem is compounded during low light conditions, i.e., at night, in early morning, and in late afternoon. The unfortunate result is that the wounded animal suffers unnecessarily due to the longer time required to find it. And all too often the hunter is unable to find or track the blood trail and never finds the game animal, which can result in prolonged animal suffering and a wasteful loss of the animal.

Thus it can be seen that needs exist for improvements to devices and methods for tracking wounded game animals. It is to such improvements that the present invention is primarily directed.

SUMMARY OF THE INVENTION

Generally described, the present invention provides a hunting device for use to aid in tracking a wounded and fleeing game animal. In an example embodiment, the tracking-assist device includes a dispenser that is carried on a bowhunting arrow and a tracer agent loaded into the dispenser. The dispenser is activated to a dispensing position upon the arrow striking and wounding the animal. And the tracer agent is released when the dispenser is activated to the dispensing position so that the released tracer agent disperses to identify an enhanced-visibility trail to aid in tracking the animal. The tracer agent is preferably provided and used in dry form.

In one aspect, the tracer agent includes a biological stain that interacts with the animal's blood to produce light. For example, the biological stain may be Bismarck brown, carmine, coomassie blue, crystal violet, DAPI, eosin, ethidium bromide, fuchsin, haematoxylin, Hoeschst stain, iodine, malchite green, methyl green, methylene blue, neutral red, Nile blue, rhodamine, safranin, or a mixture thereof.

In another aspect, the tracer agent includes a chemiluminescent compound that releases light as the result of a chemical reaction such as interacting with the animal's blood. The chemiluminescent compound may be bis-(2,4,6-trichlorophenyl) oxlate (TCPO), bis-(2,4-dinitrophenyl)oxalate (DNPO), fluorescein, luminol, or a mixture thereof. Such tracer agents are well suited for use at night.

In yet another aspect, the tracer agent includes a phosphorescent compound. The phosphorescent compound may be a commercially available glow-in-the dark paint or pigment. Such tracer agents are well suited for use at night.

In still another aspect, the tracer agent includes an effervescence-inducing agent. The effervescence-inducing agent may be a basic salt such as sodium carbonate, sodium bicarbonate, or ALKA-SELZER® brand antacid or another substance including baking soda and citric acid. Such tracer agents are well suited for use during daylight.

In a further aspect, the tracer agent includes a fluorescent pigment or dye. The fluorescent pigment or dye may be a commercially available type such as PF33 orange or another pigment or dye that produces light with or without interacting with the animal's blood and that comprises an organic compound or a metal complex incorporated into a resin such as a melamine formaldehyde sulphonamide resin. These and other included agents produce visible light to the naked eye in the daylight and at night upon exposure to a black light source.

In addition, in another aspect the present invention includes a bowhunting method for wounding and tracking an animal. The method includes providing a bowhunting arrow with a dispenser that activates to a dispensing position upon striking the animal; loading a tracer agent into the dispenser; shooting the animal with the arrow so that the arrow wounds the animal, the dispenser activates to the dispensing position and releases the tracer agent, and the tracer agent disperses and identifies an enhanced-visibility trail marked by the wounded animal as it flees; and following the enhanced-visibility trail. The step of loading the tracer agent into the dispenser may be done by the bowhunter or done by a manufacturer or a retailer of the dispenser or the tracer agent.

Also, the step of loading a tracer agent into the dispenser may include loading a tracer agent that interacts with the animal's blood to produce enhanced-visibility properties, and then the step of following the enhanced-visibility trail includes following the enhanced-visibility trail left by the animal's enhanced-visibility blood. Alternatively, the step of loading a tracer agent into the dispenser may include loading a tracer agent that produces enhanced-visibility properties regardless of interaction with the animal's blood, and then the step of following the enhanced-visibility trail includes following the enhanced-visibility trail of the tracer agent itself. In this case, the step of following the enhanced-visibility trail includes following a first portion of the enhanced-visibility trail identified by a first portion of the tracer agent that disperses onto the ground, fallen leaves, trees, bushes, and/or any other surroundings after the dispenser impacts the animal and until the animal starts bleeding out of the wound. And the trail-following step further includes following a second portion of the enhanced-visibility trail identified by a second portion of the agent that combines with the animal's flowing blood and disperses onto surroundings as the animal continues to flee.

Furthermore, in another aspect the present invention includes a method of assembling a kit for use in bowhunting to wound and track an animal. The method includes providing a dispenser for mounting onto a bowhunting arrow, wherein the dispenser activates to a dispensing position when the arrow strikes and wounds the animal; and providing a tracer agent selected for dispersing from the dispenser when activated to the dispensing position and identifying an enhanced-visibility trail marked by the wounded animal as it flees. In addition, the method may include providing an enhanced visibility enabling device, such as a black light source, and packaging it with the dispenser and the tracer agent. The method may include packaging the dispenser and tracer agent together for sale without the agent loaded into the dispenser. Or the method may include pre-loading the tracer agent into the dispenser and packaging the agent-loaded dispenser for sale ready to use. Moreover, the present invention includes a kit assembled according to any of these methods for use in bowhunting to wound and track an animal.

Accordingly, the present invention provides devices and methods for use to create an enhanced-visibility trail that aids in tracking a wounded fleeing game animal. The tracer agents and the dispensers used in the various embodiments of the invention permit tracking wounded game animals in daylight conditions, in nighttime and other low-light conditions, during or after rainy weather, and/or over several days.

The specific techniques and structures employed by the invention to improve over the drawbacks of the prior devices and accomplish the advantages described herein will become apparent from the following detailed description of the example embodiments of the invention and the appended drawings and claims.

DETAILED DESCRIPTION OF EXAMPLE EMBODIMENTS

Figure 1:
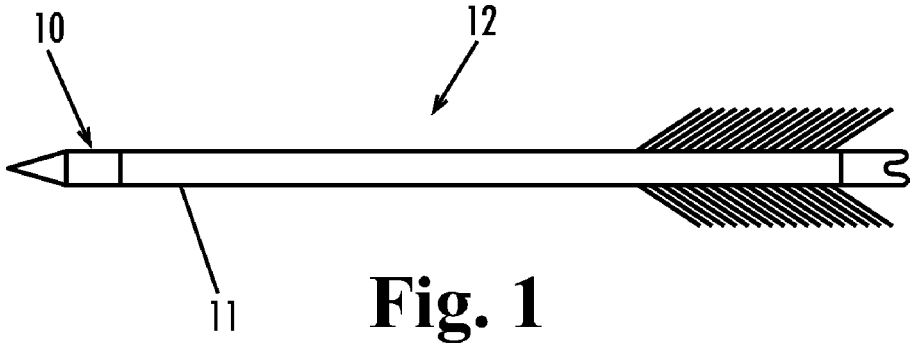
FIG. 1 is a side view of an arrow carrying a tracking-assist device according to an example embodiment of the present invention.
Figure 2:
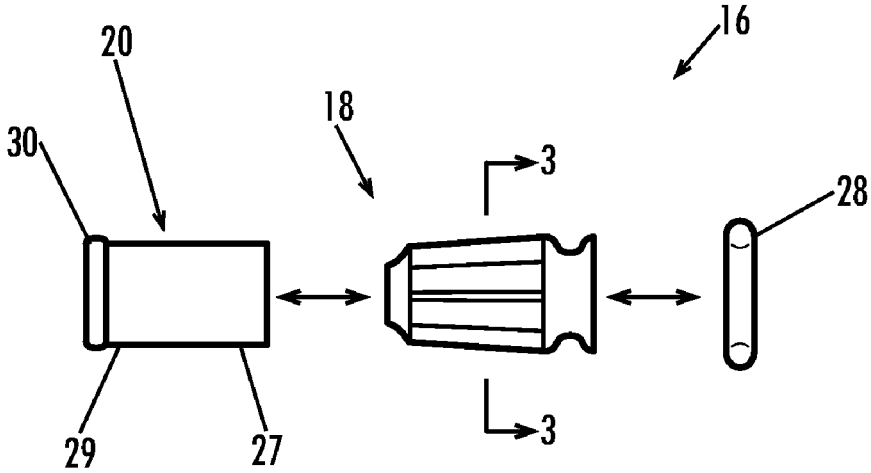
FIG. 2 is a side exploded view of a dispenser of the tracking-assist device of FIG. 1, showing a base and a cover sleeve.
Figure 3:
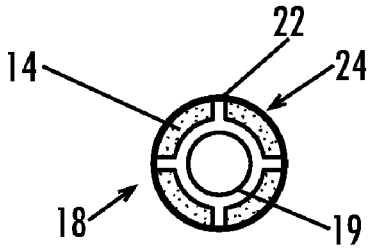
FIG. 3 is a cross section view of the dispenser taken at 3-3 of FIG. 1, showing wells in the dispenser that hold a tracer agent.

The present invention may be understood more readily by reference to the following detailed description of the invention taken in connection with the accompanying drawing figures, which form a part of this disclosure. Generally described, the present invention includes a device for use by hunters to assist in tracking wounded prey. The tracking-assist device includes a tracer agent and dispenser unit for the agent. The dispenser is designed to release the tracer agent when it strikes the targeted game animal. The tracer is selected for dispersing from the dispenser and identifying an enhanced-visibility trail of the wounded game. As used herein, an "enhanced-visibility trail" is a trail marked by a wounded, fleeing animal that is easier to see or otherwise detect than the animal's blood trail. In some embodiments the device is sold ready for use with the tracer agent pre-loaded into the dispenser, and in other embodiments the dispenser and the tracer agent are sold as a kit or separately and the hunter loads the tracer agent into the dispenser.

The invention can be implemented in a variety of different embodiments for use in different types of hunting. For example, the invention includes embodiments for use by hunters shooting arrows from bows, including traditional bows, crossbows, etc. In addition, the invention includes embodiments for use by hunters shooting projectiles from firearms, including rifles, shotguns, muzzle-loading black-powder guns, handguns, etc.

With reference now to the appended drawings, FIGS. 1-5 show a bowhunting tracking-assist device 10 according to an example embodiment of the invention. The device 10 mounts onto the shaft 11 of a conventional bowhunting arrow 12, and includes a tracer agent 14 and an agent dispenser 16. The dispenser 16 is designed to release the tracer agent 14 when the arrow strikes and drives into the animal.

The tracer agent 14 as defined herein can be one or more compounds that produce visible light either to the naked eye or with the use of a light source (e.g., black light) upon contact with the animal. For example, upon contact of the tracer agent with the animal (e.g., skin, hair, blood), the tracer agent emits visible light (i.e., color) that can be readily detected by the un-aided eye. Thus, in one aspect, the tracer agent is a compound that possesses visible color. In another aspect, the tracer agent can be a colorless compound that is converted to a colored species upon contact with the animal. Alternatively, the tracer agent can be a compound that can be detected once it is exposed to black light. In a further aspect, the tracer agent can interact with the skin or blood of the animal to make the blood or skin of the animal more visible to the naked eye. In this aspect, the tracer agent can interact with the blood or skin and form a bond such as, for example, a covalent, electrostatic, hydrogen or ionic bond to render the skin or blood more visible. In this way, the agent that interacted with the blood leaves an enhanced-visibility blood trail for the hunter to track, and/or the agent that interacted with blood, skin, or hair still present on the animal can help the hunter identify the current location of the animal.

In one aspect, the tracer agent can interact and enhance the visibility of the animal's blood upon contact between the blood of the animal and the tracer agent, thereby making it easier to track the animal by its enhanced-visibility blood trail. For example, the tracer agent can be a biological stain that upon contact with the blood of the animal produces visible light. Examples of biological stains include, but are not limited to, Bismarck brown, carmine, coomassie blue, crystal violet, DAPI, eosin, ethidium bromide, fuchsin, haematoxylin, Hoeschst stain, iodine, malchite green, methyl green, methylene blue, neutral red, Nile blue, rhodamine, or safranin. Depending upon the selection of the stain, the stain can selectively bind to proteins, oligonucleotide (e.g., DNA, RNA), blood cells, and other biological components present in blood, and fluoresce.

In another aspect, the tracer agent can be a chemiluminescent compound. Chemiluminescent compounds are compounds that release light due to the occurrence of a chemical reaction. Examples of chemiluminescent compounds include, but are not limited to, bis-(2,4,6-trichlorophenyl) oxlate (TCPO), bis-(2,4-dinitrophenyl) oxalate (DNPO), fluorescein, or luminol. In the case of luminol, which is a commercially available substance that is commonly used in the field of law enforcement, the luminol is typically provided in dry powder form and mixed with water then sprayed on a surface to detect the presence of blood. When used with the tracking-assist device 10 described herein, the luminol can be loaded into the dispenser 16 in a straight powder form, which intensifies the luminescent glowing effect and makes it last significantly longer than when diluted with water. In this aspect, when a bow hunter shoots an animal with an arrow loaded with the device 10, the luminol comes into contact with the blood and causes it to glow in the dark a bright fluorescent blue, which enhances the visibility of the blood trail so it is easier to follow, thereby aiding in the tracking of the animal. In various aspects, the chemiluminescent compound is particularly well suited for use at night.

In another aspect, the tracer agent 14 can be a phosphorescent compound. Examples of phosphorescent compounds described in WO 98/55561, WO 00/18851, WO 00/57676, WO 00/70655, and U.S. Pat. No. 6,579,632, which are incorporated by reference, can be used as the tracer agent. In one aspect, the glow-in-the-dark paints and pigments manufactured by RISK REACTOR (Huntington Beach, Calif.) can be used herein. In various aspects, the phosphorescent compound is particularly well suited for use at night.

In another aspect, the tracer agent 14 can be an effervescence-inducing agent such as, for example, a basic salt. Examples of effervescence-inducing agents include, but are not limited to, sodium carbonate, sodium bicarbonate, or ALKA-SELZER® brand antacid or another substance including baking soda and citric acid. Not wishing to be bound by theory, it is believed that when the animal's blood (e.g., highly oxygenated blood from a shot to the lungs) comes into contact with the effervescence-inducing agent, the interaction makes the red blood effervescent and thus become a thick, frothy consistency with a pink coloration. When used with the tracking-assist device 10 described herein, the effervescence-inducing agent can be loaded into the dispenser 16 in a straight powder form, which intensifies the pink bubbling effect and makes it last significantly longer than when diluted with water. In this way, when a bow hunter shoots an animal with an arrow loaded with the device 10, the effervescence-inducing agent comes into contact with the blood and causes it to foam up and turn bright pink, which enhances the visibility of the blood trail so it is easier to follow, thereby aiding in the tracking of the animal. In this aspect, the use of the effervescence-inducing agent as the tracer agent is well suited for use during daylight.

In another aspect, the tracer agent 14 can be a fluorescent compound. In one aspect, the fluorescent compound is a colored pigment or dye. Fluorescent dyes and pigments are known in the art and can be used herein. For example, the pigment or dye can be an organic compound (e.g., aromatic and heteroaromatic compounds) or metal complexes (e.g., transition metal complexes and metal oxides). The fluorescent dyes and pigments manufactured by RISK REACTOR (Huntington Beach, Calif.) can be used herein, some with better results than others. For example, the fluorescent compound can be orange PF33 available from RISK REACTOR. This fluorescent agent is well suited because when it contacts blood, the blood-agent combination still fluoresces, unlike many other known dyes and pigments. This bright orange powder is extremely visible to the naked eye in the daylight and, with the assistance of a black light, glows very well in the orange color at night. When the tracer agent is orange PF33 or a similar pigment, the bowhunting device described herein can be used in day or night conditions. In addition, the color and fluorescent effect of the tracer agent can last several days, so if an animal is shot with the bow hunting device described herein in daylight conditions, when darkness falls, the animal can be tracked and found hours or even days later. For example, the orange PF33 pigment has been found to glow for four days in testing. Furthermore, the orange PF33 or a similar fluorescent agent does not dissolve in water, and it still fluoresces when it contacts water, unlike some other known dyes and pigments.

In the case of orange PF33 and similar fluorescent pigments and dyes, these agents do not interact with the animal's blood to produce visible light, but instead produce visible light due to the physical properties of the pigment or dye. Thus, the fluorescent agent glows under black light, with or without the blood, and it is the glow of the agent that leads the hunter to the animal. This facilitates tracking the animal. The spot where the animal is at when shot might be quite some distance away from the hunter, so generally the impact spot can be difficult to identify. Typically, the animal will take off right away and it will be a number of yards (e.g., about 20 to 50 yards for some deer) until it bleeds out enough to leave a blood trail. So sometimes the hunter never finds the blood trail and thus never finds the animal. But using the orange PF33 or similar fluorescent pigments and dyes overcomes this problem. The fluorescent agent is dispensed from the dispenser at impact and it splatters about onto the animal, any nearby trees and/or bushes, the ground, and any other surroundings. The agent that is dispersed onto the ground, trees, bushes, etc. identifies the location of the animal at impact and thus identifies the beginning of the enhanced-visibility trail, so that the bowhunter can easily find the spot where the animal began fleeing. In addition, as the animal flees the spot but before it is bleeding out from the wound, the agent that is dispersed onto the animal can rub off on any trees, bushes, etc. to identify a first portion of the enhanced-visibility trail. After a number of yards (e.g., about 20 to 50 yards for some deer), the animal's blood flows sufficiently from the wound and over the dispenser so that the blood-carried agent rubs off on any trees and bushes and/or drips to the ground to identify a second portion of the enhanced-visibility trail.

Figure 6:
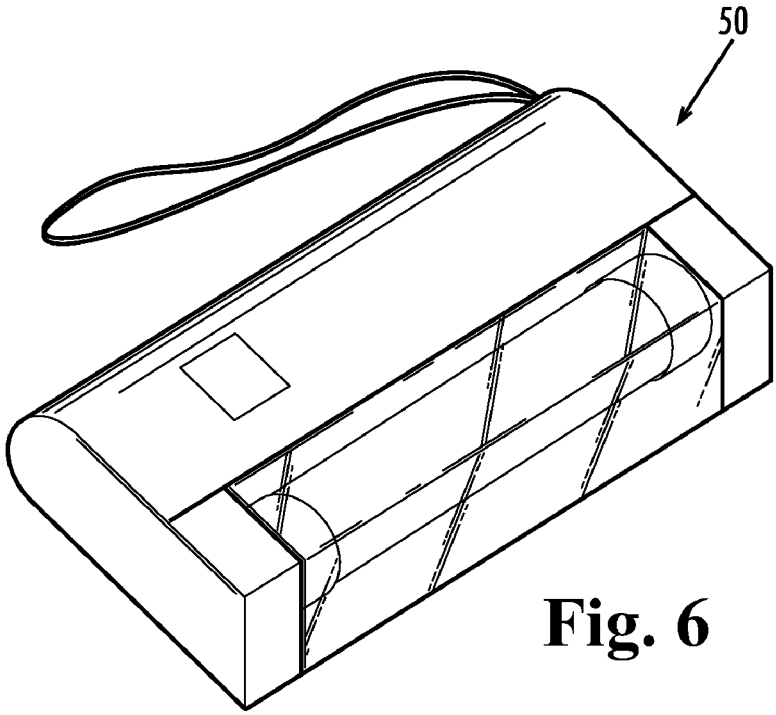
FIG. 6 is a perspective view of a portable black light unit for use in detecting certain tracer agents included in the invention.

As mentioned herein, the orange PF33 and similar fluorescent pigments and dyes glow very well at night under black light. Commercially available portable black lights 50 (see FIG. 6) can be used to detect the fluorescent agent or similar agents that glow under black light, such as the hand-held high power 9 blue LED black lights available from "DUCO TECHNOLOGIES INC." (Henderson, Nev.). The black light 50 can be packaged and sold together with the dispenser 16 and tracer agent 14 as a kit, two of these three components can be packaged and sold together as a kit, or each of these components can be provided separately. The light source may be adapted for wearing (e.g., with a strap for securing on the hunter's head), for mounting onto a weapon, or otherwise adapted for conveniently carrying and directing the light source towards the enhanced-visibility trail. Furthermore, it is contemplated to provide enhanced-visibility enabling devices other than black lights, such as goggles or other devices having an optic lens with a filter, or a pair of optic lenses with a gas sealed between them, with the tracer agent being one or more compounds that glow or otherwise have enhanced-visibility properties when viewed through the lenses.

It will be understood that the tracer agent can be used in dry form (e.g., powder, granules, etc.) or in liquid form (e.g., mixed with a solvent including, but not limited to, water, an organic solvent, or a mixture thereof). Alternatively, the tracer agent can be incorporated into or part of a polymer matrix. For example, the dye or pigment can be incorporated into a resin including, but not limited to, a melamine formaldehyde sulphonamide resin. The amount of tracer agent can also vary depending upon the targeted animal and the desired intensity of the visible signal to be detected by the hunter. It is also contemplated that other components can be used in combination with the tracer agent to facilitate the tracking of the animal including, but not limited to, odor- or sound-inducing agents.

Turning now to the dispenser 16, it is carried by the arrow 12 and it holds the tracer agent 14 that will mark the enhanced-visibility trail if the arrow finds its target. The dispenser 16 releases the tracer agent 14 for dispersal when the dispenser strikes and drives at least partially into the targeted game animal.

In the typical commercial embodiment shown in the drawing figures, for example, the dispenser 16 is provided by a commercially available "pod" unit that is sold by Hilda Askew d/b/a THE POD (Jackson, Miss.). This pod unit is known and used as a drug-carrying mechanism for delivering to the animal a dose of succinylcholine (commonly known by and available under the brand name ANECTINE®). Succinylcholine is a muscle relaxant used in anesthesiology during surgery, and hoofed animals are extremely sensitive to it. Some bowhunters use this pod unit loaded with this drug to kill animals when the hunter has not otherwise made a kill shot. It is not known to use the pod unit with anything other than this drug.

The pod-type dispenser 16 includes a base 18 and a flexible cover sleeve 20. The base 18 has a bore 19 that receives therethrough the shaft 11 of a conventional bowhunting arrow 12, for mounting the dispenser onto the arrow at its front behind the arrow tip (e.g., field point or broad head). In addition, the base 18 has longitudinal ridges 22 that form wells 24 for receiving the tracer agent 14. The flexible cover sleeve 20 fits over the wells 24 of the base 18 to hold the tracer agent 14 therein. The flexible cover sleeve 20 has a forward portion 29 that is removably held in a loaded position on the base 18, for example, by a first integral O-ring 30. And the flexible cover sleeve 20 has a rearward portion 27 that is held in a loaded position on the base, for example, by a second O-ring 28. The base 18 may be made of hard plastic or other material, and the flexible cover sleeve 20 may be made of rubber, a polymer, or another flexible material. A section of the neck of a balloon, with its integral O-ring, may be used for the sleeve 20.

Figure 4:
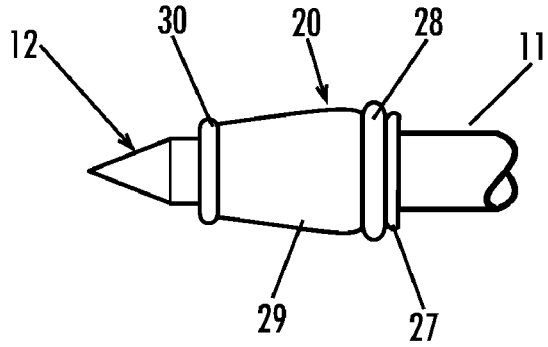
FIG. 4 is a side view of the tracking-assist device of FIG. 1, showing dispenser in a loaded position.
Figure 5:
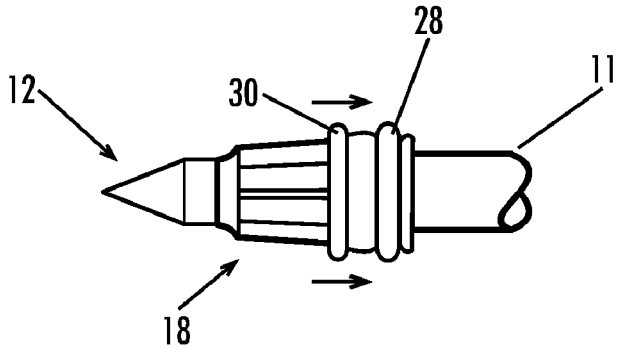
FIG. 5 is a side view of the tracking-assist device of FIG. 4, showing dispenser in a dispensing position.

In use, when the arrow 12 hits the animal, the tracking-assist device 10 (or at least a front portion of it) is driven into the animal so that resistance forces cause the cover sleeve 20 to roll back from the loaded position of FIG. 4 to the dispensing position of FIG. 5. As the cover sleeve 20 is displaced from the loaded position towards the dispensing position, it releases the blood-enhancing agent 14 for dispersal to identify the enhanced-visibility trail.

In alternative embodiments, the tracking-assist device is provided with a different dispenser. For example, the dispenser may include the flexible sleeve with two integral O-rings, but without the base, such that the tracer agent is held between the arrow shaft and the cover sleeve and added by the user prior to use. In another alternative embodiment, the device has an inner sleeve that snugly fits onto the arrow shaft and has longitudinal ridges defining wells for holding the tracer agent, and a roll-back outer sleeve like that described above. In yet another alternative embodiment, the arrow has the wells (e.g., longitudinally arranged slots or grooves) cut or otherwise formed directly in it (e.g., by the manufacturer or the hunter), and the flexible sleeve fits over the wells, without the need for the base. In still another alternative embodiment, the dispenser has a cover with peel-back or tear-away flaps or other removable elements. In another alternative embodiment, the dispenser is integrally formed as a part of the arrow tip, with the arrow tip defining one or more wells for carrying the tracer agent. And in yet another alternative embodiment, the dispenser may be another commercially available "pod" unit, such as a syringe-style pod unit. It will be understood that the invention is intended to include these and other devices that can be used to carry and dispense the tracer agent for the purposes described herein.

It should be emphasized that the commercially available components identified for use in the example embodiments described herein, particularly the pod-type dispenser and the various tracer agents that can be loaded into the dispenser, are each known in their disparate fields. But these tracer agents are not known to have ever been used for tracking game animals, and the pod dispenser is not known to have ever been used for anything other than delivering the drug succinylcholine into game animals. So there is no known suggestion or motivation to combine the tracer agents and the pod dispenser into the various embodiments described herein.

The present invention also provides methods of tracking a wounded animal. The methods include the steps of providing a bowhunting arrow with a dispenser, loading a tracer agent into the dispenser, shooting the animal with the arrow wherein the arrow wounds the animal and the dispenser releases the tracer agent for dispersal thereby identifying an enhanced-visibility trail marked by the fleeing animal, and following the enhanced-visibility trail. The tracer agent and the dispenser used in the method may be any of those described herein. The step of loading the tracer agent into the dispenser may be done by the hunter, by the manufacturer or retailer of the dispenser, or by another.

For tracer agents that interact with the animal's blood to produce visible light or other enhanced-visibility properties (e.g., luminol, antacids, or blood stains), the step of following the enhanced-visibility trail includes following the enhanced-visibility trail left by the animal's enhanced-visibility blood. And for tracer agents that produce an enhanced-visibility property such as visible light with or without interacting with the animal's blood (e.g., orange PF33 fluorescent pigment), the step of following the enhanced-visibility trail includes following the enhanced-visibility trail of the agent itself. In this case, the hunter follows a first portion of the enhanced-visibility trail identified by a first portion of the agent that disperses onto the surroundings (e.g., trees, bushes, and the ground) after the dispenser impacts the animal and until the animal starts bleeding out of the wound. And the hunter follows a second portion of the enhanced-visibility trail identified by a second portion of the agent that combines with the animal's flowing blood and disperses onto trees, bushes, the ground, or other surroundings as the animal continues to flee. The second portion of the enhanced-visibility trail is typically extremely easy to track, while the first portion of the enhanced-visibility trail enables the hunter to find the easily tracked second portion of the trail.

The present invention also provides kits and methods of assembling kits for use in bowhunting to track wounded game. The methods include the steps of providing a dispenser for mounting onto a bowhunting arrow, and providing a tracer agent selected for dispersing from the dispenser and identifying an enhanced-visibility trail marked by a fleeing wounded animal. The methods may further include the step of providing an enhanced visibility enabling device such as a black light source and packaging it with the tracer agent —and the dispenser. In addition, the methods may include the step of packaging the dispenser and tracer agent together without the agent loaded into the dispenser, so that after purchase the tracer agent can be loaded into the dispenser by the hunter. Or the methods may include the step of preloading the tracer agent into the dispenser and packaging the agent-loaded dispenser for sale ready to use, with the preloading typically done by the manufacturer or retailer of the dispenser or the tracer agent. The tracer agent, the dispenser, and the light source used in the method may be any of those described herein.

Accordingly, it can be seen that the present invention provides advantages over conventional hunting gear and methods. Advantageously, the present invention provides devices and methods of creating an enhanced-visibility trail for tracking a wounded fleeing game animal. In the example embodiments described herein, the enhanced-visibility trail can be used for tracking wounded game animals in daylight conditions, in nighttime and other low-light conditions, during or after rainy weather, and/or over several days.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been described with reference to example and alternative embodiments, it will be understood by those skilled in the art that a variety of modifications, additions and deletions are within the scope of the invention, as defined by the following claims.

What is claimed is:

1. A bowhunting device for use with an arrow to aid in tracking an animal wounded by the arrow, the device comprising:

a dispenser carried by the arrow, wherein the dispenser is activated to a dispensing position when the arrow strikes and wounds the animal; and a tracer agent loaded into the dispenser and released when the dispenser is activated to the dispensing position, wherein the released tracer agent interacts with the animal's blood to produce enhanced-visual properties, wherein the released tracer agent and the animal's blood disperse to identify an enhanced-visibility trail to aid in tracking the animal.

2. The device of claim 1, wherein the tracer agent comprises a biological stain.

3. The device of claim 2, wherein the biological stain comprises Bismarck brown, carmine, coomassie blue, crystal violet, DAPI, eosin, ethidium bromide, fuchsin, haematoxylin, Hoeschst stain, iodine, malchite green, methyl green, methylene blue, neutral red, Nile blue, rhodamine, safranin, or a mixture thereof.

4. The device of claim 2, wherein the biological stain binds to one or more biological components in the animal's blood.

5. The device of claim 4, wherein the biological stain binds to proteins, oligonucleotide, or blood cells in the animal's blood.

6. The device of claim 4, wherein upon binding to one or more of the biological components in the animal's blood, the biological stain fluoresces.

7. The device of claim 1, wherein the tracer agent comprises a chemiluminescent compound.

8. The device of claim 7, wherein the chemiluminescent compound comprises bis-(2,4,6-trichlorophenyl) oxlate (TCPO), bis-(2,4-dinitrophenyl)oxalate (DNPO), fluorescein, luminol, or a mixture thereof.

9. The device of claim 1, wherein the tracer agent comprises an effervescence-inducing agent.

10. The device of claim 1, wherein the tracer agent is provided in a dry form.

11. The device of claim 1, wherein the tracer agent comprises one or more compounds that upon interaction with the animal's blood produce visible light to the naked eye or upon exposure to a light source.

12. A bowhunting method for wounding and tracking an animal, comprising:

providing a bowhunting arrow with a dispenser that activates to a dispensing position upon striking the animal;

loading a tracer agent into the dispenser, wherein tracer agent interacts with the animal's blood to produce enhanced-visibility properties;

shooting the animal with the arrow, wherein the arrow wounds the animal, the dispenser activates to the dispensing position and releases the tracer agent, and the tracer agent interacts with the animal's blood, disperses, and identifies an enhanced-visibility trail marked by the wounded animal as it flees; and following the enhanced-visibility left by the dispersed tracer agent and the animal's blood.

13. The bowhunting method of claim 12, wherein the step of loading the tracer agent into the dispenser is done by a bowhunter.

14. The bowhunting method of claim 12, wherein the step of loading the tracer agent into the dispenser is done by a manufacturer or a retailer of the dispenser or the tracer agent.

15. The method of claim 12, wherein the tracer agent comprises a biological stain.

16. The method of claim 15, wherein the biological stain comprises Bismarck brown, carmine, coomassie blue, crystal violet, DAPI, eosin, ethidium bromide, fuchsin, haematoxylin, Hoeschst stain, iodine, malchite green, methyl green, methylene blue, neutral red, Nile blue, rhodamine, safranin, or a mixture thereof.

17. The method of claim 15, wherein the biological stain binds to one or more biological components in the animal's blood, and fluoresces.

18. The method of claim 12, wherein the tracer agent comprises a chemiluminescent compound.

19. The method of claim 18, wherein the chemiluminescent compound comprises bis-(2,4,6-trichlorophenyl) oxlate (TCPO), bis-(2,4-dinitrophenyl)oxalate (DNPO), fluorescein, luminol, or a mixture thereof.

20. The method of claim 12, wherein the tracer agent comprises an effervescence-inducing agent.

21. A bowhunting method for wounding and tracking a animal, comprising:

providing a bowhunting arrow with a dispenser that activates to a dispensing position upon striking the animal;

loading a tracer agent into the dispenser, wherein the tracer agent produces enhanced-visiblity properties regardless of interaction with the animal's blood;

shooting the animal with the arrow, wherein the arrow wounds the animal, the dispenser activates to the dispensing position and releases the tracer agent, and the tracer agent disperses and identifies an enhanced-visibility trail marked by the wounded animal as it flees; and following the enhanced-visibility trail of the tracer agent itself, including following a first portion of the enhanced-visibility trail identified by a first portion of the tracer agent that disperses onto surroundings after the dispenser impacts the animal and until the animal starts bleeding out of the wound, and following a second portion of the enhanced-visibility trail identified by a second portion of the agent that combines with the animal's flowing blood and disperses onto surroundings as the animal continues to flee.

22. A method of assembling a kit for use in bowhunting to wound and track an animal, comprising:

providing a dispenser for carrying by bowhunting arrow, wherein the dispenser activates to a dispensing position when the arrow strikes and wounds the animal;

providing a tracer agent selected for dispersing from the dispenser when activated to the dispensing position and identifying an enhanced-visibility trail marked by the wounded animal as it flees;

providing a black light source device that interacts with the tracer agent to produce enhance-visibility properties; and packaging the dispenser, the tracer agent, and the black light source device together into the kit.

23. The method of claim 22, further comprising packaging the dispenser and tracer agent together for sale without the agent loaded into the dispenser.

24. The method of claim 22, further comprising pre-loading the tracer agent into the dispenser and packaging the agent-loaded dispenser for sale ready to use.

25. The kit assembled according to the method of claim 22 for use in bowhunting to wound and track an animal.

26. A bowhunting device for use with an arrow to aid in tracking an animal wounded by the arrow, the device comprising:

a dispenser for mounting onto the arrow, wherein the dispenser is activated to a dispensing position when the arrow strikes and wounds the animal; and a tracer agent loaded into the dispenser and released when the dispenser is activated to the dispensing position, wherein the released tracer agent disperses to identify an enhanced-visibility trail to aid in tracking the animal, wherein the tracer agent comprises an effervescence-inducing agent.

* * * * *